US009717951B2

(12) United States Patent
Tsutsui et al.

(10) Patent No.: US 9,717,951 B2
(45) Date of Patent: Aug. 1, 2017

(54) EXERCISE EQUIPMENT AND EXERCISE EQUIPMENT SET

(71) Applicant: SoftBank Corp., Tokyo (JP)

(72) Inventors: Takashi Tsutsui, Tokyo (JP); Shigenori Imanaka, Tokyo (JP); Kosuke Tomonaga, Tokyo (JP)

(73) Assignee: SoftBank Corp, Tokyo (JP)

( * ) Notice: Subject to any disclaimer, the term of this patent is extended or adjusted under 35 U.S.C. 154(b) by 0 days.

(21) Appl. No.: 14/972,086

(22) Filed: Dec. 17, 2015

(65) Prior Publication Data

US 2016/0101320 A1 Apr. 14, 2016

Related U.S. Application Data

(63) Continuation of application No. PCT/JP2014/003063, filed on Jun. 9, 2014.

(30) Foreign Application Priority Data

Jun. 17, 2013 (JP) ..... 2013-126404
Jun. 17, 2013 (JP) ..... 2013-126405
(Continued)

(51) Int. Cl.
*A63B 24/00* (2006.01)
*A63B 71/06* (2006.01)
(Continued)

(52) U.S. Cl.
CPC ..... *A63B 24/0062* (2013.01); *A63B 21/0004* (2013.01); *A63B 21/072* (2013.01);
(Continued)

(58) Field of Classification Search
CPC . A63B 24/00; A63B 24/0062; A63B 21/0724; A63B 21/0726; A63B 21/0728;
(Continued)

(56) References Cited

U.S. PATENT DOCUMENTS 6,852,068 B2 * 2/2005 Ogawa ..... A63B 24/00 482/1
2002/0128127 A1 * 9/2002 Chen ..... A63B 21/0726 482/106
(Continued)

FOREIGN PATENT DOCUMENTS

EP 1075859 A1 2/2001
EP 2586502 A1 5/2013
(Continued)

OTHER PUBLICATIONS

International Preliminary Report on Patentability for International Application No. PCT/JP2014/003063 issued by the International Bureau of WIPO on Dec. 30, 2015.
(Continued)

*Primary Examiner* — Glenn Richman

(57) ABSTRACT

Provided is Exercise equipment including a gripping section that is gripped by a user; a weight section that is connected to the gripping section; a first electrode that is arranged on the gripping section; a second electrode that is arranged on the weight section; a measuring section that measures at least one of body fat percentage of the user and an electrocardiogram waveform of the user, using the first electrode and the second electrode.

24 Claims, 9 Drawing Sheets

(30) Foreign Application Priority Data

Jun. 17, 2013 (JP) ..... 2013-126406
Jun. 17, 2013 (JP) ..... 2013-126407

(51) Int. Cl.
*A63B 21/072* (2006.01)
*A63B 21/075* (2006.01)
*A63B 21/00* (2006.01)
*A63B 23/12* (2006.01)

(52) U.S. Cl.
CPC ..... *A63B 21/075* (2013.01); *A63B 21/0722* (2015.10); *A63B 21/0724* (2013.01); *A63B 21/0726* (2013.01); *A63B 21/0728* (2013.01); *A63B 21/4035* (2015.10); *A63B 21/4043* (2015.10); *A63B 23/12* (2013.01); *A63B 71/0619* (2013.01); *A63B 2024/0065* (2013.01); *A63B 2220/17* (2013.01); *A63B 2220/803* (2013.01); *A63B 2220/833* (2013.01); *A63B 2225/54* (2013.01); *A63B 2230/01* (2013.01); *A63B 2230/04* (2013.01); *A63B 2230/50* (2013.01); *A63B 2230/70* (2013.01); *A63B 2230/75* (2013.01)

(58) Field of Classification Search
CPC ..... A63B 21/075; A63B 21/0722; A63B 21/4035; A63B 21/4043; A63B 21/0004; A63B 21/072
USPC ..... 482/1–9
See application file for complete search history.

(56) References Cited

U.S. PATENT DOCUMENTS

| | | | | |
|---|---|---|---|---|
| 2004/0176226 | A1* | 9/2004 | Carlson ..... | A63B 21/0083 482/112 |
| 2006/0234832 | A1 | 10/2006 | Toyama et al. | |
| 2009/0318267 | A1 | 12/2009 | Park et al. | |

FOREIGN PATENT DOCUMENTS

| | | | |
|---|---|---|---|
| JP | S57-134059 | U | 8/1982 |
| JP | 2000-237364 | A | 9/2000 |
| JP | 2001-029322 | A | 2/2001 |
| JP | 2002-253700 | A | 9/2002 |
| JP | 2004-129997 | A | 4/2004 |
| JP | 2004-223271 | A | 8/2004 |
| JP | 2007-094723 | A | 4/2007 |
| JP | 2011-136131 | A | 7/2011 |
| JP | 2013-056011 | A | 3/2013 |

OTHER PUBLICATIONS

International Search Report for International Application No. PCT/JP2014/003063, issued by the Japan Patent Office on Aug. 26, 2014.
Office Action issued for counterpart Japanese Application 2013-126405, issued by the Japan Patent Office on Mar. 3, 2015.
Office Action issued for counterpart Japanese Application 2013-126404, issued by the Japan Patent Office on Sep. 8, 2015.

* cited by examiner

EXERCISE EQUIPMENT AND EXERCISE EQUIPMENT SET

The contents of the following Japanese and international patent application(s) are incorporated herein by reference:
2013-126404 filed in JP on Jun. 17, 2013;
2013-126405 filed in JP on Jun. 17, 2013;
2013-126406 filed in JP on Jun. 17, 2013;
2013-126407 filed in JP on Jun. 17, 2013; and
PCT/JP2014/003063 filed on Jun. 9, 2014

BACKGROUND

1. Technical Field

The present invention relates to exercise equipment and an exercise equipment set.

2. Related Art

A conventional exercise promoting apparatus is known that is attached to exercise equipment, such as a dumbbell, counts the number of exercise motions and notifies the user of this number, as shown in Patent Document 1, for example. Furthermore, a training device is known that includes an RFID reader for receiving radio waves from an RFID tag affixed to a weight in an attachable and detachable manner, and this training device recognizes the mass of the weight to which the RFID tag is attached, as shown in Patent Document 2, for example. A body fat scale is known that can measure body weight and body fat percentage by having a user stand barefoot on the scale, as shown in Patent Document 3, for example. A dumbbell is known whose mass can be changed by a weight attached to the outside of the dumbbell, as shown in Patent Document 4, for example.

Patent Document 1: Japanese Patent Application Publication No. 2000-237364

Patent Document 2: Japanese Patent Application Publication No. 2011-136131

Patent Document 3: Japanese Patent Application Publication No. 2001-029322

Patent Document 4: Japanese Patent Application Publication No. 2004-129997

There is a desire to provide exercise equipment in which more functions can be implemented than in the conventional devices.

DESCRIPTION OF EXEMPLARY EMBODIMENTS

Hereinafter, some embodiments of the present invention will be described. The embodiments do not limit the invention according to the claims, and all the combinations of the features described in the embodiments are not necessarily essential to means provided by aspects of the invention.

Figure 1:
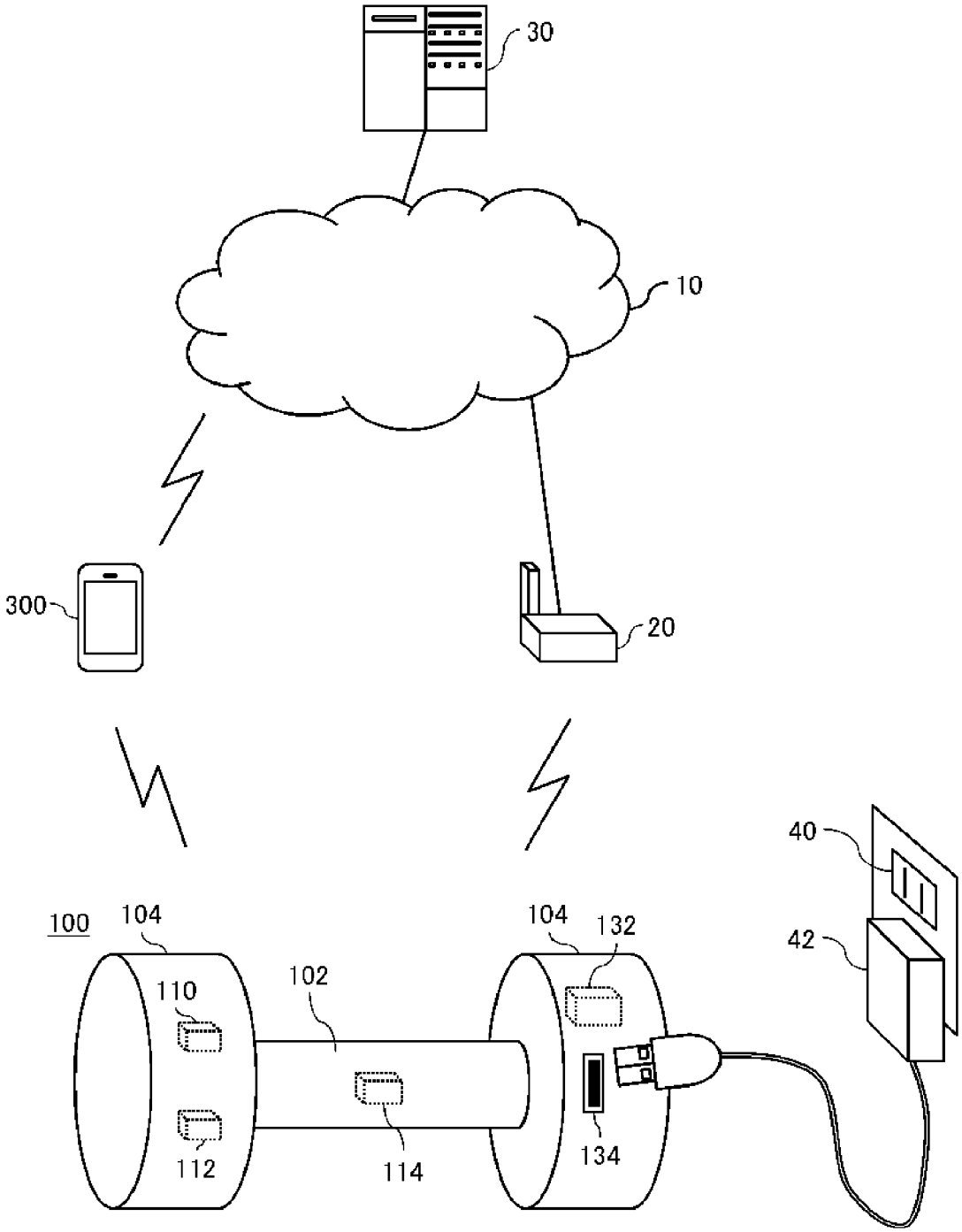
FIG. 1 schematically shows an exemplary dumbbell 100 and a communication environment of the dumbbell 100.

FIG. 1 schematically shows an exemplary dumbbell 100 and communication environment of the dumbbell 100. The dumbbell 100 is an example of exercise equipment. The present embodiment describes a dumbbell 100 that performs various processes using power supplied from a battery 132.

The dumbbell 100 includes a gripping section 102 that is gripped by the user and a weight section 104 that is connected to the gripping section 102. In the present embodiment, the dumbbell 100 includes a communication unit 110, a processing unit 112, a gyro sensor 114, and a USB port 134.

The communication unit 110 communicates wirelessly with an information terminal 300 and an access point 20. The communication standard of the wireless communication can be exemplified by Bluetooth (Registered Trademark), BLE (Bluetooth Low Energy), wireless LAN, and infrared communication. The information terminal 300 may be a terminal capable of wireless communication, such as a mobile telephone. The access point 20 may be a wireless LAN access point, a Bluetooth access point, or the like.

The processing unit 112 counts the number of exercise motions using the dumbbell 100, based on an output value of a gyro sensor 114, for example. The communication unit 110 transmits the number counted by the processing unit 112 to the information terminal 300, for example. In this way, the user exercising with the dumbbell 100 can check the number of exercise motions via the information terminal 300. The communication unit 110 may upload the number counted by the processing unit 112 to a data server 30, via the access point 20 and the Internet 10. In this way, it is possible to manage the exercise history of a user with the data server 30, for example.

The data server 30 may be realized by activating software or a program defining the operation of each section of the data server 30, with an information processing apparatus having a general structure including a data unit having a CPU, a ROM, a RAM, a communication interface, and the like; an input unit such as a keyboard, a touch panel, and a microphone; an output unit such as a display, and speaker; and a storage unit such as a memory and an HDD. The data server 30 may be a virtual server or a cloud system.

The battery 132 supplies power to the communication unit 110, the processing unit 112, the gyro sensor 114, and the like. The battery 132 may perform USB charging via a USB port 134. For example, the battery 132 may be charged by connecting the USB port 134 to a USB-AC adapter 42 connected to an electrical outlet 40. Here, USB charging of the battery 132 is provided as an example, but the method of charging the battery 132 is not limited to this, and the charging method may be cradle charging, charging with a power supply cable, or the like.

Figure 2:
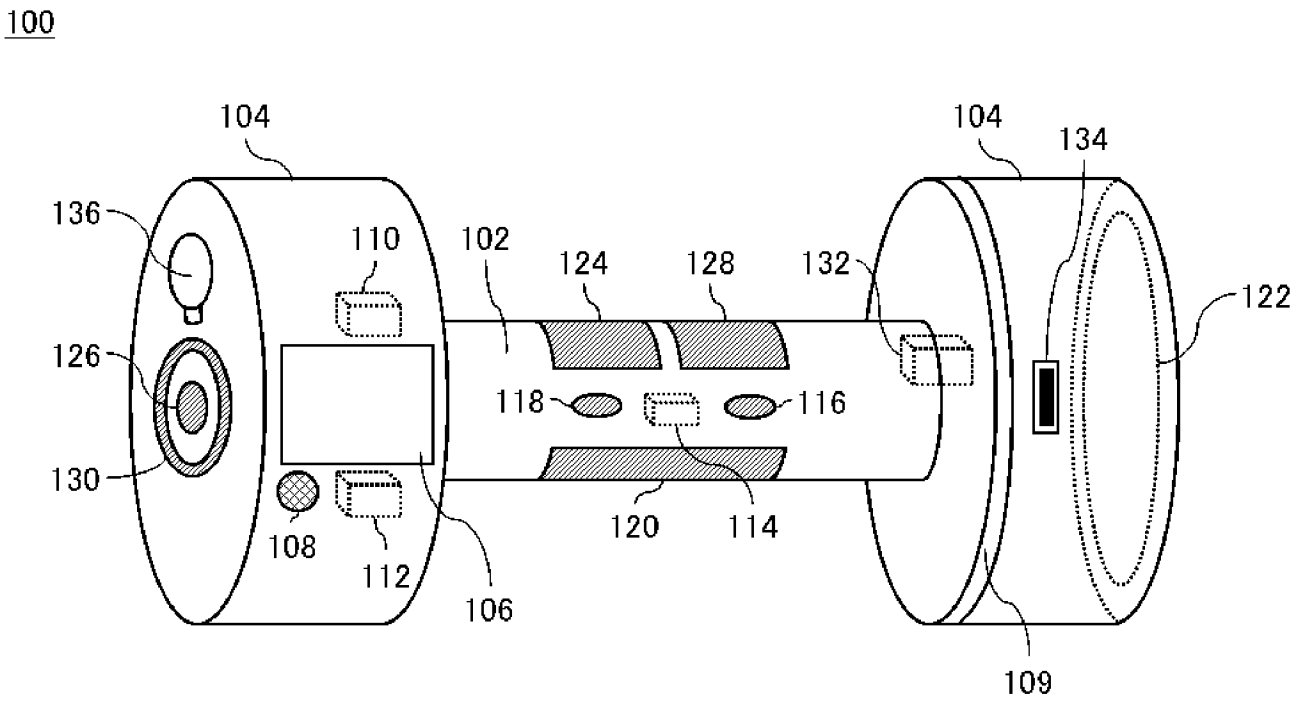
FIG. 2 schematically shows an exemplary configuration of the dumbbell 100.
Figure 3:
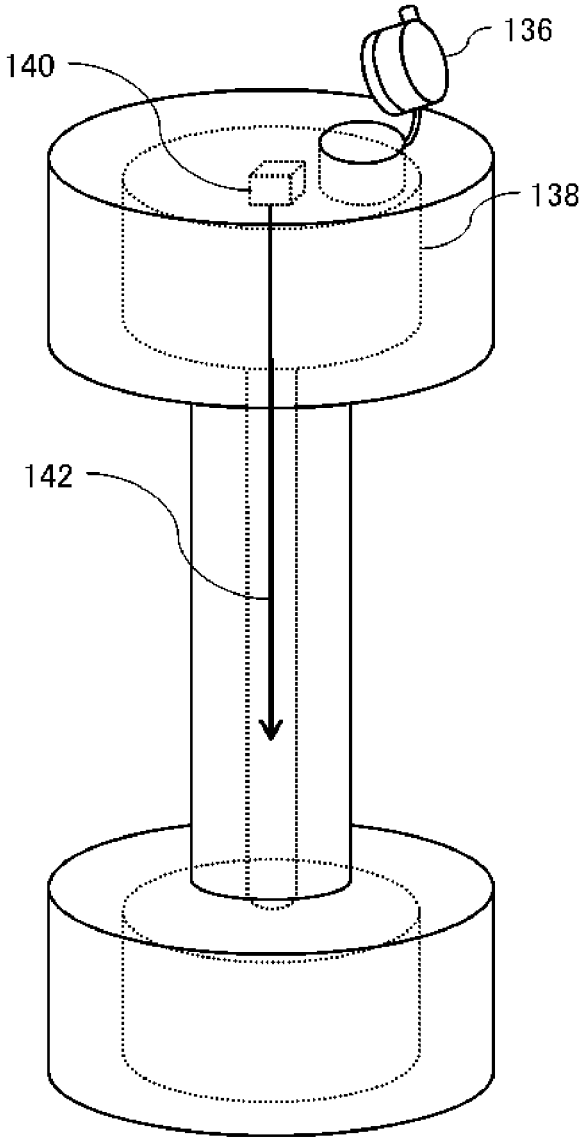
FIG. 3 is a drawing mainly for describing the container section 138 arranged inside the dumbbell 100.

FIG. 2 schematically shows an exemplary configuration of the dumbbell 100. FIG. 3 is a drawing mainly for describing the container section 138 arranged within the dumbbell 100. The following describes an example in which the dumbbell 100 includes a display 106, a speaker 108, a light emitting section 109, a communication unit 110, a processing unit 112, a gyro sensor 114, a temperature sensor 116, a heart rate sensor 118, a pressure sensor 120, a pressure sensor 122, a current supply electrode 124, a current supply electrode 126, a voltage detection electrode 128, a voltage detection electrode 130, the battery 132, the USB port 134, a container lid 136, the container section 138, and a distance sensor 140. The dumbbell 100 is not limited to including all of these components, and may instead include a portion of these components.

The display 106 is a touch panel display, for example. Specifically, the display 106 may have a display function and an input function. The display 106 may be a display other than a touch panel display, in which case the dumbbell 100 may include a separate input section, such as a manipulation button. The speaker 108 outputs a voice corresponding to the processing of the dumbbell 100. The light emitting section 109 emits light according to the processing of the dumbbell 100. The light emitting section 109 is an LED, for example.

The gyro sensor 114 is an example of a movement measuring section. The gyro sensor 114 is arranged on the gripping section 102, for example. The gyro sensor 114 may be housed inside the gripping section 102.

The temperature sensor 116 is an example of a temperature measuring section. The temperature sensor 116 is arranged on the gripping section 102, for example. The processing unit 112 may acquire the temperature measured by the temperature sensor 116. The processing unit 112 may display the acquired temperature in the display 106.

In this way, the user can know the temperature of the space where the dumbbell 100 is placed. The user can check his/her own body temperature by checking the temperature when the gripping section 102 is being gripped. By arranging the temperature sensor 116 on the gripping section 102, the user can know a change in the body temperature of the user during exercise. The processing unit 112 may output the acquired temperature from the speaker 108 as voice output.

The processing unit 112 may acquire the temperature measured by the temperature sensor from the temperature sensor arranged within a wireless communication range of the communication unit 110, via the communication unit 110. If the information terminal 300 has a temperature measurement function, the processing unit 112 may receive the temperature measured by the information terminal 300 from the information terminal 300 via the communication unit 110. The processing unit 112 may acquire, from a body temperature sensor attached to the body of the user, the temperature measured by this body temperature sensor, via the communication unit 110.

The heart rate sensor 118 is an example of a heart rate measuring section. The heart rate sensor 118 is arranged on the gripping section 102, for example. The processing unit 112 may acquire the heart rate measured by the heart rate sensor 118. The processing unit 112 may display the acquired heart rate in the display 106.

The user can know his/her own heart rate by viewing the display 106 while the gripping section 102 is being gripped. By arranging the heart rate sensor 118 on the gripping section 102, the user can know a change in his/her heart rate during exercise. The processing unit 112 may output the acquired heart rate from the speaker 108 as voice output. The processing unit 112 may acquire the heart rate of the user from a heart rate sensor other than the heart rate sensor 118. For example, the heart rate sensor 118 may acquire the heart rate measured by a heart rate sensor attached to the body of the user from this heart rate sensor via the communication unit 110.

The pressure sensor 120 is arranged on the gripping section 102. The pressure sensor 120 is an example of a gripping section pressure measuring section. The processing unit 112 may acquire the pressure measured by the pressure sensor 120. The processing unit 112 may measure the weight of the dumbbell 100, based on the acquired pressure. The processing unit 112 may display the measured weight of the dumbbell 100 in the display 106. The user can know the weight of the dumbbell 100 by viewing the display 106 while the gripping section 102 is gripped in a state where the pressure sensor 120 is facing downward. The processing unit 112 may output the measured weight of the dumbbell 100 from the speaker 108 as voice output.

The pressure sensor 122 is arranged on one end of the weight section 104. The pressure sensor 122 is an example of an end pressure measuring section. The processing unit 112 may acquire the pressure measured by the pressure sensor 122. The processing unit 112 may measure the weight of the dumbbell 100 based on the acquired pressure. The processing unit 112 may display the measured weight of the dumbbell 100 in the display 106. The user can check the weight of the dumbbell 100 by viewing the display 106 while the dumbbell 100 is in an upright state with the pressure sensor 122 facing downward. The processing unit 112 may output the measured weight of the dumbbell 100 from the speaker 108 as voice output.

The current supply electrode 124 is arranged on the gripping section 102. The current supply electrode 126 is arranged on the weight section 104. The voltage detection electrode 128 is arranged on the gripping section 102. The voltage detection electrode 130 is arranged on the weight section 104. The current supply electrode 124 is an example of a first current supply electrode. The current supply electrode 126 is an example of a second current supply electrode. The voltage detection electrode 128 is an example of a first voltage detection electrode. The voltage detection electrode 130 is an example of a second voltage detection electrode.

The processing unit 112 may calculate the body fat percentage of the user by employing a so-called BI technique (Bioelectrical Impedance technique) for the current supply electrode 124, the current supply electrode 126, the voltage detection electrode 128, and the voltage detection electrode 130. Specifically, the processing unit 112 may calculate the body fat percentage of the user by performing current supply for the current supply electrode 124 and the current supply electrode 126 and voltage detection for the voltage detection electrode 128 and the voltage detection electrode 130.

For example, the processing unit 112 measures the impedance by performing current supply and voltage detection in a state where the user touches the current supply electrode 124 and the voltage detection electrode 128 with one hand and touches the current supply electrode 126 and the voltage detection electrode 130 with the other hand. The processing unit 112 then calculates the body fat percentage of the user based on personal data including the height and weight of the user and the measured impedance. The personal data may be recorded in advance by the user, for example. The processing unit 112 may display the calculated body fat percentage in the display 106. In this way, the user can know his/her own body fat percentage. The processing unit 112 may output the calculated body fat percentage from the speaker 108 as voice output.

The container lid 136 is a lid for the container section 138. The container section 138 contains at least a liquid in a manner enabling discharge. The container section 138 contains water or sand, for example. The user can change the weight of the dumbbell 100 by storing water, sand, or the like in the container section 138.

The distance sensor 140 is an example of a volume measuring section that measures the volume of the liquid or the like contained in the container section 138. The distance sensor 140 measures the distance to the surface of the liquid contained in the container section 138, by radiating radiated light 142 into the container section 138 and receiving the resulting reflected light. In this way, the volume of the liquid contained in the container section 138 is measured. The processing unit 112 may acquire the measured volume. The processing unit 112 may calculate the weight of the volume by multiplying the density of the liquid by the acquired volume. The processing unit 112 may calculate the weight of the dumbbell 100 by adding together the weight of the dumbbell 100 that does not contain any liquid and the weight of the liquid.

Figure 4:
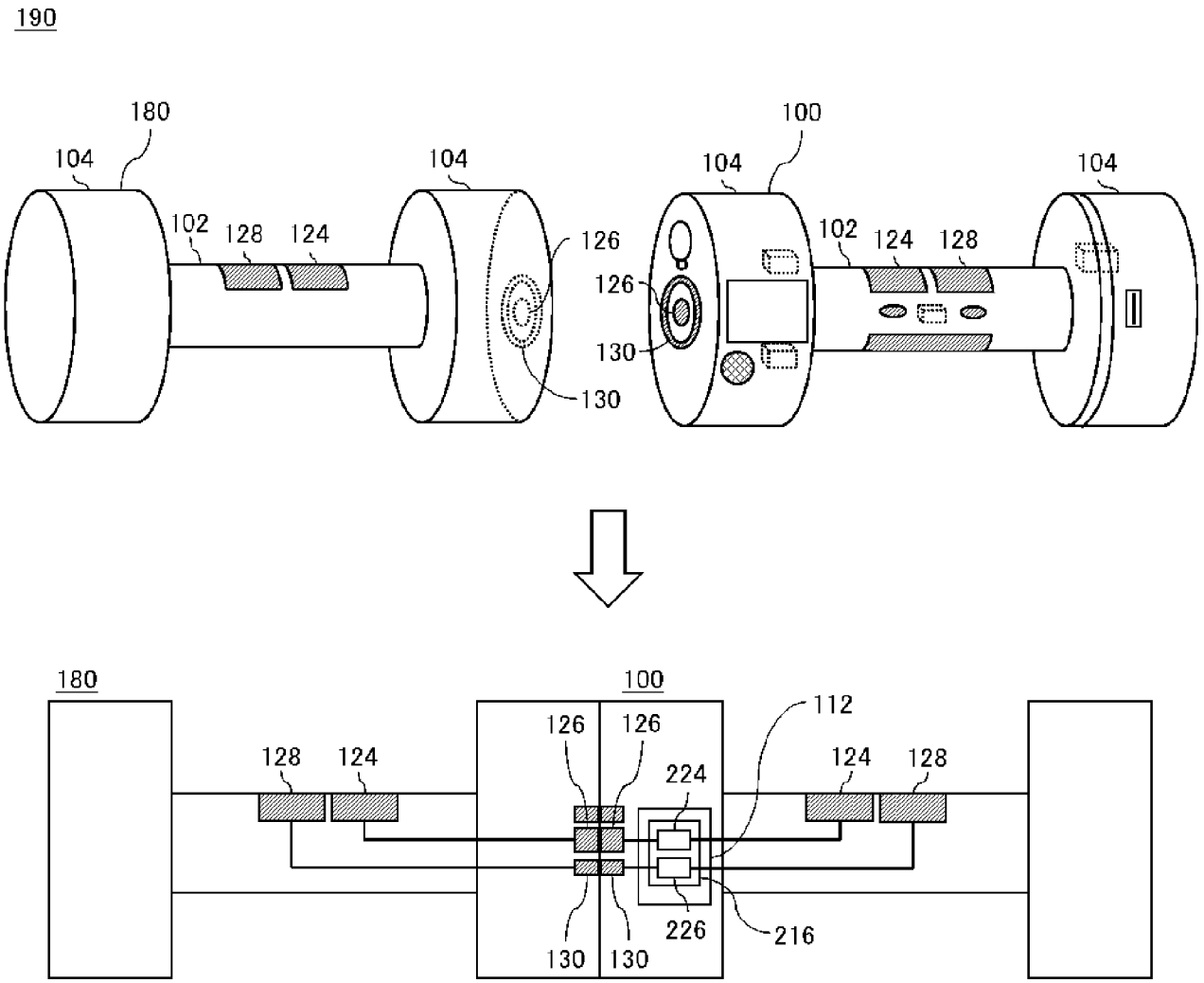
FIG. 4 schematically shows an exemplary dumbbell set 190 that includes a dumbbell 100 and a dumbbell 180.

FIG. 4 schematically shows an exemplary dumbbell set 190 including a dumbbell 100 and a dumbbell 180. The dumbbell 180 includes the gripping section 102 and the weight section 104, and also includes at least the current supply electrode 124, the current supply electrode 126, the voltage detection electrode 128, and the voltage detection electrode 130. The dumbbell 180 may have the same configuration as the dumbbell 100. The dumbbell 100 is an example of first exercise equipment, the dumbbell 180 is an example of second exercise equipment, and the dumbbell set 190 is an example of an exercise equipment set.

The processing unit 112 of the dumbbell 100 shown in FIG. 4 includes an impedance measuring section 216, and the impedance measuring section 216 includes a current supplying section 224 and a voltage detecting section 226. By having the current supply electrode 126 and voltage detection electrode 130 of the dumbbell 100 respectively aligned with the current supply electrode 126 and the voltage detection electrode 130 of the dumbbell 180, the current supply electrode 124 of the dumbbell 100 and the current supply electrode 124 of the dumbbell 180 are electrically conductive with the current supplying section 224. Furthermore, the voltage detection electrode 128 of the dumbbell 100 and the voltage detection electrode 128 of the dumbbell 180 are electrically conductive with the voltage detecting section 226.

As a result of the user gripping the gripping section 102 of the dumbbell 100 with one hand, gripping the gripping section 102 of the dumbbell 180 with the other hand, and aligning the dumbbell 100 and the dumbbell 180 as shown in the drawing, a current path including the body of the user is formed. The impedance measuring section 216 measures the impedance, as a result of the current supplying section 224 supplying a current and the voltage detecting section 226 performing voltage detection. The processing unit 112 may calculate the body fat percentage of the user based on the impedance measured by the impedance measuring section 216 and the personal data including the height and weight of the user.

A conventional body fat scale is known that can measure the weight and body fat percentage by having the user stand barefoot on the scale, but when measuring the body fat percentage before exercise using the exercise equipment, for example, it is complicated to prepare for exercise and begin exercising after becoming barefoot and measuring the body fat percentage with the body fat scale. In contrast to this, with the dumbbell 100 and the dumbbell 180 according to the present embodiment, when the user grips the dumbbell 100 with one hand and grips the dumbbell 180 with the other hand to exercise, for example, it is possible to easily measure the body fat percentage by aligning the dumbbell 100 and the dumbbell 180 before, after, or during the exercise. As shown in FIG. 4, the current supply electrodes 126 and the voltage detection electrodes 130 of the dumbbell 100 and the dumbbell 180 may be arranged on the surfaces opposite the surfaces of the weight sections 104 connected by the gripping sections 102. Furthermore, each current supply electrode 126 may be arranged at the center of one end of a weight section 104, and each voltage detection electrode 130 may be formed as a circle that surrounds a current supply electrode 126. In this way, the user can align the dumbbell 100 and the dumbbell 180 without worrying about misalignment of the dumbbell 100 and the dumbbell 180 in the rotational direction.

The present embodiment mainly focuses on an example in which the dumbbell 100 measures the body fat percentage of the user, but the dumbbell 100 may measure an electrocardiogram waveform of the user. For example, the processing unit 112 measures the electrocardiogram waveform of the user by using an electrode provided on the gripping section 102 and an electrode provided on a weight section 104. The processing unit 112 may measure the electrocardiogram waveform using the current supply electrode 124 and the current supply electrode 126, or may measure the electrocardiogram waveform using electrodes provided separately from the gripping section 102 and the weight sections 104.

The processing unit 112 may display the measured electrocardiogram waveform in the display 106. The processing unit 112 may transmit the measured electrocardiogram waveform to the communication unit 110. The communication unit 110 may transmit the electrocardiogram waveform measured by the processing unit 112 to the information terminal 300, for example. The communication unit 110 may upload the electrocardiogram waveform measured by the processing unit 112 to the data server 30 via the access point 20 and the Internet 10, for example.

The processing unit 112 may control the display 106 and the speaker 108 based on the content of the measured electrocardiogram waveform. For example, when the measured electrocardiogram waveform indicates an irregular pulse, the processing unit 112 may output to the display 106 and the speaker 108 a message prompting the user to stop exercising.

Figure 5:
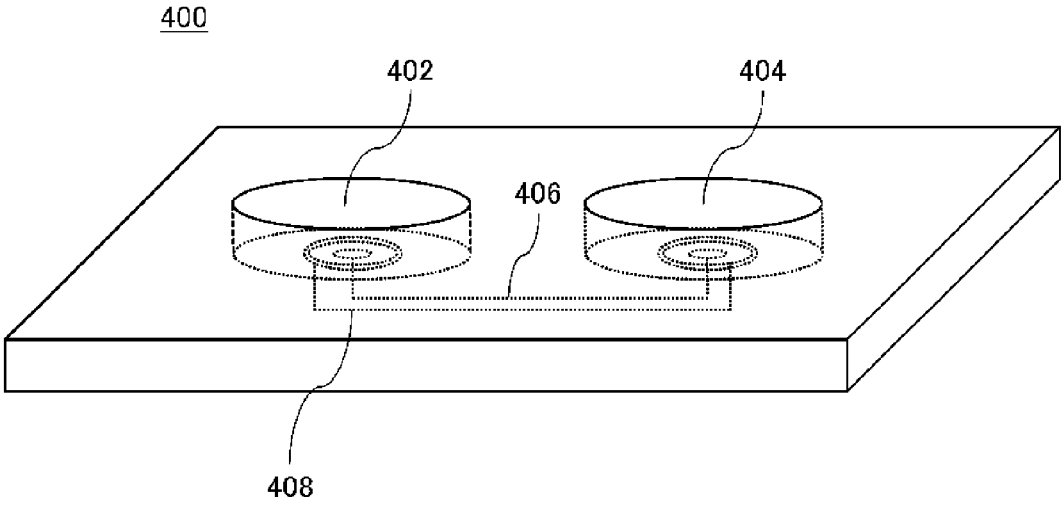
FIG. 5 schematically shows a mounting platform 400 on which the dumbbell set 190 is mounted.

FIG. 5 schematically shows a mounting platform 400 on which the dumbbell set 190 is mounted. The mounting platform 400 includes a mounting section 402, a mounting section 404, an electrical path 406, and an electrical path 408. The dumbbell 100 and the dumbbell 180 may be respectively mounted on the mounting section 402 and the mounting section 404.

The electrical path 406 creates electrical conduction between the current supply electrodes 126 of the dumbbell 100 and the dumbbell 180 mounted on the mounting section 402 and the mounting section 404. The electrical path 408 creates electrical conduction between the voltage detection electrodes 130 of the dumbbell 100 and the dumbbell 180 mounted on the mounting section 402 and the mounting section 404. In this way, in a state where the user grips the dumbbell 100 with one and grips the dumbbell 180 with the other hand while the dumbbell 100 and the dumbbell 180 are mounted on the mounting section 402 and the mounting section 404, the dumbbell 100 can measure the body fat percentage of the user.

Here, an example is described in which the dumbbell 100 measures the body fat percentage of the user, but the mounting platform 400 may measure the body fat percentage of the user. In this case, the mounting platform 400 includes the impedance measuring section 216.

Figure 6:
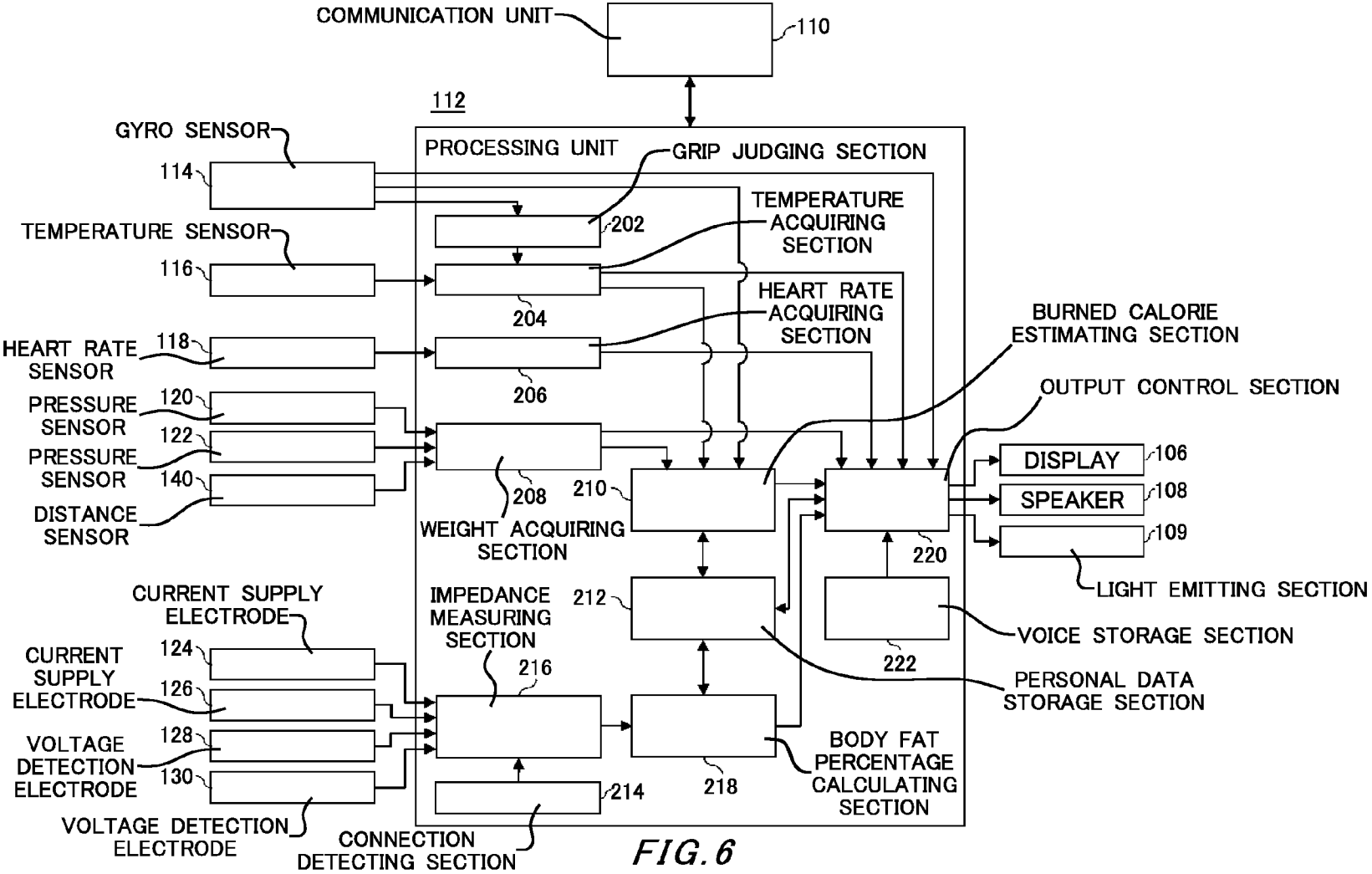
FIG. 6 schematically shows an exemplary function configuration of the dumbbell 100.

FIG. 6 schematically shows an exemplary function configuration of the dumbbell 100. Here, an example is described in which the dumbbell 100 includes the display 106, the speaker 108, the communication unit 110, the processing unit 112, the gyro sensor 114, the temperature sensor 116, the heart rate sensor 118, the pressure sensor 120, the pressure sensor 122, the current supply electrode 124, the current supply electrode 126, the voltage detection electrode 128, and the voltage detection electrode 130.

The processing unit 112 includes a grip judging section 202, a temperature acquiring section 204, a heart rate acquiring section 206, a weight acquiring section 208, a burned calorie estimating section 210, a personal data storage section 212, a connection detecting section 214, an impedance measuring section 216, a body fat percentage calculating section 218, an output control section 220, and a sound storage section 222. The processing unit 112 need not include all of these components, and may instead include a portion of these components.

The grip judging section 202 judges whether the gripping section 102 is being gripped. The grip judging section 202 judges whether the gripping section 102 is being gripped based on an output value from the gyro sensor 114, for example. If the movement of the dumbbell 100 is not detected to be continuous for at least a predetermined time period by the gyro sensor 114, the gripping section 102 may judge that the gripping section 102 is not being gripped. Furthermore, the gripping section 102 may judge that the gripping section 102 is being gripped while motion of the dumbbell 100 is being detected by the gyro sensor 114.

The grip judging section 202 may judge whether the gripping section 102 is being gripped based on an output value from another sensor. For example, the grip judging section 202 may judge that the gripping section 102 is being gripped when the output value of the heart rate sensor 118 indicates that a heart rate is detected, and may judge that the gripping section 102 is not being held when the output value of the heart rate sensor 118 does not indicate that a heart rate is being detected. Furthermore, the grip judging section 202 may judge that the gripping section 102 is being gripped when the output value of the pressure sensor 120 indicates that pressure is being detected, and may judge that the gripping section 102 is not being held when the output value of the pressure sensor 120 does not indicate that pressure is being detected.

The temperature acquiring section 204 acquires the temperature measured by the temperature sensor 116. The temperature acquiring section 204 may acquire the surrounding temperature of the dumbbell 100 or the body temperature of the user gripping the gripping section 102, based on the output value of the grip judging section 202. For example, the temperature acquiring section 204 acquires the temperature measured by the temperature sensor 116 in a state where the user is not gripping the gripping section 102 as the surrounding temperature of the dumbbell 100. Furthermore, the temperature acquiring section 204 acquires the temperature measured by the temperature sensor 116 in a state where the user is gripping the gripping section 102 as the body temperature of the user, for example.

The present embodiment describes an example in which the dumbbell 100 includes one temperature sensor 116 arranged on the gripping section 102, but the present invention is not limited to this, and the dumbbell 100 may include a temperature sensor arranged on the gripping section 102 and a temperature sensor arranged on a weight section 104. In this case, the temperature acquiring section 204 may acquire the temperature measured by the temperature sensor arranged on the gripping section 102 as the body temperature of the user and acquire the temperature measured by the temperature sensor arranged on the weight section 104 as the surrounding temperature. The temperature sensor arranged on the gripping section 102 is an example of a gripping section temperature measuring section, and the temperature sensor arranged on the weight section 104 is an example of a weight section temperature measuring section.

The temperature acquiring section 204 may acquire the temperature measured by other temperature sensors via the communication unit 110. For example, the temperature acquiring section 204 may acquire a temperature from a temperature sensor arranged on the wireless communication range of the communication unit 110, via the communication unit 110. The temperature acquiring section 204 may acquire the temperature acquired by a room temperature sensor as the surrounding temperature. The temperature acquiring section 204 may acquire the body temperature measured by a body temperature sensor attached to the body of the user.

The heart rate acquiring section 206 acquires the heart rate measured by the heart rate sensor 118. The heart rate acquiring section 206 may acquire the heart rate measured by another heart rate sensor, via the communication unit 110. For example, the heart rate acquiring section 206 acquires the heart rate of the user measured by a heart rate sensor attached to the body of the user, via the communication unit 110.

The weight acquiring section 208 measures the weight of the dumbbell 100. For example, the weight acquiring section 208 calculates the weight by converting the pressure output by the pressure sensor 120 into a weight. The weight acquiring section 208 may measure the weight of the dumbbell 100 based on the output value of the gyro sensor 114. For example, the weight acquiring section 208 acquires the pressure output by the pressure sensor 120 when movement of the dumbbell 100 is not detected by the gyro sensor 114, and calculates the weight of the dumbbell 100 by converting this pressure into a weight. In this way, it is possible to prevent the pressure added to the pressure sensor 120 by the movement of the dumbbell 100 from being added to the calculated weight of the dumbbell 100. The weight acquiring section 208 and the pressure sensor 120 are an example of a weight measuring section.

The weight acquiring section 208 calculates the weight by converting the pressure output by the pressure sensor 122 into a weight, for example. The weight acquiring section 208 and the pressure sensor 122 are an example of a weight measuring section.

The weight acquiring section 208 may calculate the weight of the liquid in the container section 138 by multiplying the density of the liquid by the volume of the liquid in the container section 138 determined based on the distance detected by the distance sensor 140, for example. The weight acquiring section 208 may calculate the weight of the dumbbell 100 by adding together the weight of the liquid and the weight of the dumbbell 100 when containing no liquid. The distance sensor 140 is an example of a volume measuring section, and the distance sensor 140 and weight acquiring section 208 are an example of a weight measuring section.

The burned calorie estimating section 210 estimates the calories burned by the user, based on the movement of the dumbbell 100 measured by the gyro sensor 114. The burned calorie estimating section 210 estimates the burned calories according to a METs (Metabolic Equivalents) technique, for example. Specifically, the burned calorie estimating section 210 may estimate the burned calories by multiplying together the weight of the user stored in the personal data storage section 212, the continuous time during which the gyro sensor 114 detected the dumbbell 100 being used for exercise, the dumbbell exercise METs number, which is from 3.5 to 6.0, and a value of 1.05.

The burned calorie estimating section 210 may estimate the burned calories according to another calculation technique. For example, the burned calorie estimating section 210 may reference data in which is registered the burned calories that are burned by one repetition with the dumbbell 100, and calculate the burned calories by multiplying this burned calorie data by the number of repetitions measured by the gyro sensor 114.

The burned calorie estimating section 210 may further estimate the burned calories based on the temperature acquired by the temperature acquiring section 204. For example, the burned calorie estimating section 210 may calculate the burned calories by multiplying the burned calories calculated according to the METs technique or the like by a coefficient exhibiting a smaller value when the surrounding temperature acquired by the temperature acquiring section 204 is higher. In this way, the value of the burned calories can be calculated to be smaller when the surrounding temperature is higher and to be larger when the surrounding temperature is lower.

As another example, the burned calorie estimating section 210 may calculate the burned calories by multiplying the burned calories calculated according to the METs technique or the like by a coefficient exhibiting a larger value when the body temperature of the user acquired by the temperature acquiring section 204 is higher. In this way, the burned calories can be calculated to be higher when the body temperature is higher and to be lower when the body temperature is lower. Furthermore, the burned calorie estimating section 210 may calculate the burned calories based on both the surrounding temperature and the body temperature of the user acquired by the temperature acquiring section 204.

The burned calorie estimating section 210 may calculate the burned calories by adding together the calories burned by exercise and the basal metabolic rate. For example, the burned calorie estimating section 210 may calculate the daily basal metabolic rate of a user, using the Harris-Benedict Equation. Specifically, the daily basal metabolic rate of a user is calculated by inputting the weight, height, and age of the user into Equitation 1 and Equation 2.

$$\text{female basal metabolic rate}=665+\text{weight (kg)}\times 9.6+\text{height (cm)}\times 1.7-\text{age}\times 7.0 \qquad \text{Equation 1:}$$

$$\text{male basal metabolic rate}=66+\text{weight (kg)}\times 13.7+\text{height (cm)}\times 5.0-\text{age}\times 6.8 \qquad \text{Equation 2:}$$

The burned calorie estimating section 210 converts the daily basal metabolic rate of the user into the basal metabolic rate during the time when the user was exercising. For example, if the user exercised for one hour, the basal metabolic rate calculated using the Harris-Benedict Equation is divided by 24.

Furthermore, the burned calorie estimating section 210 may apply the body temperature of the user acquired by the temperature acquiring section 204 to the calculated basal metabolic rate. For example, the burned calorie estimating section 210 multiplies the calculated basal metabolic rate by a coefficient in order to increase the basal metabolic rate when the body temperature is higher. Specifically, the burned calorie estimating section 210 may calculate the basal metabolic rate by multiplying the basal metabolic rate by a coefficient that increases the basal metabolic rate by 7% for every increase of 1° Fahrenheit in the body temperature of the user. In this way, the basal metabolic rate can be calculated in consideration of the body temperature of the user.

Furthermore, the burned calorie estimating section 210 may apply the surrounding temperature acquired by the temperature acquiring section 204 to the calculated basal metabolic rate. For example, the burned calorie estimating section 210 multiplies the calculated basal metabolic rate by a coefficient in order to increase the basal metabolic rate when the surrounding temperature is lower. In this way, the basal metabolic rate can be calculated in consideration of the surrounding temperature.

The burned calorie estimating section 210 may calculated the calories burned by exercise by applying the age and weight of the user and the time that the user exercised to Expression 3.

$$\text{burned calories}=\text{exercise coefficient}\times\text{age coefficeint}\times\text{weight (kg)}\times\text{time (minutes)} \qquad \text{Expression 3:}$$

The exercise coefficient is a coefficient assigned to each type of exercise. The age coefficient is a coefficient that has a smaller value for higher ages.

The burned calorie estimating section 210 calculates the burned calories to be provided to the user by adding together the calculated calories burned by exercise and the calculated basal metabolic rate. In this way, the estimation accuracy of the burned calories can be increased by estimating the burned calories while using the basal metabolic rate calculated in consideration of the surrounding temperature and the body temperature of the user.

The burned calorie estimating section 210 may estimate the burned calories based on the weight of the dumbbell 100 acquired by the weight acquiring section 208. For example, the burned calorie estimating section 210 may calculated the burned calories by multiplying the burned calories calculated according to the METs technique or the like by a coefficient that exhibits a higher value when the weight of the dumbbell 100 acquired by the weight acquiring section 208 is larger. In this way, the burned calories value can be calculated to be higher when the user exercises with a heavier dumbbell 100 than when the user exercises with a lighter dumbbell 100.

The personal data storage section 212 stores personal data of the user. The personal data storage section 212 may store personal data that is input by the user via the display 106, which is a touch panel display. If the dumbbell 100 includes an input section, the personal data storage section 212 may store personal data input by the user via the input section. The personal data storage section 212 may store personal data received from the information terminal 300 via the communication unit 110. The personal data storage section 212 may acquire personal data that includes the weight of the user or the like, via the communication unit 110, from a weight scale having a wireless communication function arranged in the wireless communication range of the communication unit 110, for example.

The connection detecting section 214 is electrically connected to the current supply electrode 124 and the current supply electrode 126, and detects the electrical connection between the voltage detection electrode 128 and the voltage detection electrode 130. The connection detecting section 214 may check whether there is an electrical connection by periodically testing the current supply. The dumbbell 100 may include a separate touch sensor and the connection detecting section 214 may detect the connection by acquiring an output value of this touch sensor.

The impedance measuring section 216 performs an impedance measurement on the current supply electrode 124, the current supply electrode 126, the voltage detection electrode 128, and the voltage detection electrode 130. The impedance measuring section 216 supplies current to the current supply electrode 124 and the current supply electrode 126 and performs voltage detection on the voltage detection electrode 128 and the voltage detection electrode 130, thereby measuring the impedance. The impedance measuring section 216 may start the impedance measurement according to instructions from the user. The impedance measuring section 216 may start the impedance measurement in response to the connection detection by the connection detecting section 214.

The body fat percentage calculating section 218 calculates the body fat percentage of the user gripping the gripping section 102. The body fat percentage calculating section 218 may calculate the body fat percentage according to the BI technique. For example, the body fat percentage calculating section 218 calculates the body fat percentage of the user based on the impedance measured by the impedance measuring section 216 and the personal data stored in the personal data storage section 212. The body fat percentage calculating section 218 may calculate the body fat percentage based on the impedance and the personal data indicating the gender, age, height, and weight of the user. The personal data storage section 212 may store the personal data of the user that is set in advance by the user. The body fat percentage calculating section 218 may calculate a body composition value other than the body fat percentage, such as the basal metabolic rate or the body age.

The output control section 220 controls the output to the display 106, the speaker 108, and the light emitting section 109. The output control section 220 may control the output based on the various results of the processing performed by the dumbbell 100.

The output control section 220 may control the output based on the output value of the gyro sensor 114. For example, the output control section 220 causes the number of exercise movements of the dumbbell 100 measured by the gyro sensor 114 to be output from at least one of the display 106 and the speaker 108. The output control section 220 may cause at least one of the display 106 and the speaker 108 to count up the number of exercise movements of the dumbbell 100. The output control section 220 may cause at least one of the display 106 and the speaker 108 to count down the number of exercise movements of the dumbbell 100.

If the gyro sensor 114 has detected exercise continuing for at least a predetermined time, the output control section 220 may cause at least one of the display 106 and he speaker 108 to output a message indicating that there is excessive exercise. If the gyro sensor 114 has measured exercise continuing for at least a predetermined time, the output control section 220 may cause the light emitting section 109 to emit light indicative of a warning, such as red light. In this way, the user can notice when the user has performed excessive exercise.

If the gyro sensor 114 has detected rolling movement of the dumbbell 100, the output control section 220 may cause the speaker 108 to output a warning noise, a voice message providing notification of danger, or the like. In this way, a notification can be provided to the surrounding area when the dumbbell 100 falls and rolls.

If the gyro sensor 114 has detected specified movement of the dumbbell 100, the output control section 220 may perform a process corresponding to the specified movement. For example, the output control section 220 switches the voice output ON/OFF in response to the detection of specified movement. As a specific example, if the dumbbell 100 is measured to have moved half of a rotation horizontally and then return to its original orientation at a speed that is less than or equal to a predetermined speed, the output control section 220 switches the voice output ON/OFF. In this way, it is possible for the user to turn the voice ON/OFF while continuing to exercise.

The output control section 220 may compare movement indicating an exercise movement form that is registered in advance to the movement measured by the gyro sensor 114, and control output of the comparison results. For example, if the measured movement can be judged to match movement indicating a registered exercise movement form, the output control section 220 causes the speaker 108 to output a voice message indicating that the exercise may continue without change. If the measured movement cannot be judged to match movement indicating a registered exercise movement form, the output control section 220 may cause the speaker 108 to output a voice message in order to make the movement become closer to the registered exercise movement form. For example, if the measured movement is compared to movement indicating the correct exercise movement form of lifting and lowering exercise movement of a dumbbell 100 that has been registered, and it is judged that the magnitude of the measured movement is smaller, the output control section 220 may cause the speaker 108 to output a voice message in stating that the dumbbell 100 should be moved farther.

The output control section 220 may transmit the movement measured by the gyro sensor 114 to the information terminal 300, the data server 30, and the like, via the communication unit 110. The output control section 220 and the communication unit 110 are an example of a movement transmitting section.

The data server 30 that receives the movement from the output control section 220 may perform a process based on movement information transmitted from a plurality of the dumbbells 100. For example, the data server 30 receives the number of times the dumbbell 100 is lifted and lowered from each of the plurality of dumbbells 100, and performs a process corresponding to the received total number of times that the dumbbells 100 were lifted and lowered. For example, according to the received number of times, the data server 30 provides an animation of an object such as a candy house or the Eiffel tower being lifted up. In this way, it is possible to improve the motivation to exercise for a plurality of users by providing motivation for lifting up an object by having the users work together.

The output control section 220 may control the output based on the temperature received from the temperature acquiring section 204. For example, the output control section 220 causes at least one of the display 106 and the speaker 108 to output the surrounding temperature received from the temperature acquiring section 204. As another example, the output control section 220 causes at least one of the display 106 and the speaker 108 to output the body temperature of the user received from the temperature acquiring section 204.

The output control section 220 may transmit the temperature received from the temperature acquiring section 204 to the information terminal 300, the data server 30, and the like, via the communication unit 110. The communication unit 110 may include a temperature information transmitting section that transmits temperature information indicating the temperature received from the temperature acquiring section 204, and a movement information transmitting section that transmits movement information indicating the movement received from the gyro sensor 114. The communication unit 110 may include a burned calorie receiving section that receives the burned calories estimated by another terminal, such as the information terminal 300, the data server 30, or the like, according to the received movement information and temperature information.

The output control section 220 may control the output based on the heart rate received from the heart rate acquiring section 206. For example, the output control section 220 causes at least one of the display 106 and the speaker 108 to output the heart rate received from the heart rate acquiring section 206. As another example, the output control section 220 causes the speaker 108 to output a voice corresponding to the heart rate received from the heart rate acquiring section 206.

The output control section 220 may cause the speaker 108 to output an effect sound in synchronization with the heart rate. In this way, an exercising user can recognize a change in his/her heart rate. The output control section 220 may cause the light emitting section 109 to emit light in synchronization with the heart rate.

If the heart rate is less than a predetermined threshold value, the output control section 220 may cause the speaker 108 to output a voice message prompting the user to perform the dumbbell 100 lifting and lowering movement more quickly, and if the heart rate is greater than a predetermined threshold value, the output control section 220 may cause the speaker 108 to output a voice message prompting the user to perform the dumbbell 100 lifting and lowering movement more slowly.

The output control section 220 may cause at least one of the display 106, the speaker 108, and the light emitting section 109 to output a result obtained by checking the heart rate received from the heart rate acquiring section 206 against medical information of the user stored in the personal data storage section 212. For example, if the heart rate received from the heart rate acquiring section 206 exceeds a safe heart rate value included in the medical information, the output control section 220 causes at least one of the display 106 and the speaker 108 to output a message prompting the user to reduce the exercise pace or a message prompting the user to stop exercising. Furthermore, if the heart rate received from the heart rate acquiring section 206 exceeds a safe heart rate value included in the medical information, the output control section 220 may cause the light emitting section 109 to emit light with a color indicating a warning, such as red light.

The output control section 220 may control the output based on the weight received from the weight acquiring section 208. For example, the output control section 220 causes at least one of the display 106 and the speaker 108 to output the weight received from the weight acquiring section 208. The output control section 220 may control at least one of the display 106 and the speaker 108 to periodically output the weight received from the weight acquiring section 208. In this way, change in the weight can be easily confirmed when the user pours a liquid such as water into the container section 138 in a state where the dumbbell 100 is standing upright with the pressure sensor 122 facing downward, for example.

The output control section 220 may control the output based on the burned calories received from the burned calorie estimating section 210. For example, the output control section 220 causes at least one of the display 106 and the speaker 108 to output the burned calories received from the burned calorie estimating section 210.

The output control section 220 may control the output based on the burned calories received from the burned calorie estimating section 210 and the burned calories estimated in the past. For example, if the burned calories received from the burned calorie estimating section 210 are equal to the highest amount of burned calories in the past, the output control section 220 causes at least one of the display 106 and the speaker 108 to output a message indicating this fact. In this way, the motivation for the user to exercise can be improved.

The output control section 220 may cause the display 106 to output the personal data stored in the personal data storage section 212. For example, the output control section 220 causes the display 106 to output the height, weight, age, gender, and the like of the user. The output control section 220 may cause the display 106 to output a setting screen for setting the personal data.

The output control section 220 may control the output based on the body fat percentage received from the body fat percentage calculating section 218. For example, the output control section 220 may cause at least one of the display 106 and the speaker 108 to output the body fat percentage received from the body fat percentage calculating section 218.

The output control section 220 may cause the speaker 108 to output voice data stored in the sound storage section 222. For example, the output control section 220 plays back music data stored in the sound storage section 222.

The output control section 220 may change the playback speed of the music data based on the output value of the gyro sensor 114. For example, the output control section 220 compares the speed of the lifting and lowering movement of the dumbbell 100 to a predetermined threshold value, causes the playback speed of the music data to be faster according to how much faster the lifting and lowering movement is than the threshold value, and causes the playback speed of the music data to be slower according to how much slower the lifting and lowering movement is than the threshold value. In this way, the user can recognize how much faster or slower the exercise movement speed is than a reference speed.

The output control section 220 may cause the speaker 108 to output a voice stored in the sound storage section 222 based on the output value of the gyro sensor 114, in order to realize a so-called sound game. For example, the output control section 220 causes the speaker 108 to play back music, compares the timing of the rising and falling of the gyro sensor 114 to a predetermined timing, and causes the speaker 108 to output a voice corresponding to the comparison results. For example, the voice is played back to say "Bad, Bad, Bad, Bad, Good, Good, Excellent."

The output control section 220 may control any one of the display 106 and the speaker 108 according to the charge state of the battery 132. For example, if the remaining charge amount of the battery 132 is less than a predetermined threshold value, the output control section 220 causes at least one of the display 106 and the speaker 108 to output a message warning that the remaining charge amount is low. In this way, the user can be prompted to charge the battery 132 before the charge in the battery 132 is completely gone.

The present embodiment describes an example in which the output control section 220 controls the output to the display 106, the speaker 108, and the light emitting section 109, but the present invention is not limited to this. The output control section 220 may control output to a display, a speaker, and a light emitting section of the information terminal 300, via the communication unit 110. In this way, it is possible to provide various outputs to the user exercising with the dumbbell 100 near the information terminal 300.

The dumbbell 100 may perform processing in connection with the information terminal 300. For example, if an exercise schedule is registered with a calendar function of the information terminal 300, the output control section 220 of the dumbbell 100 controls the speaker 108 to output an alert sound when the scheduled exercise time is reached. In this way, the user can be made aware that exercise is scheduled. The output control section 220 may continue outputting the alert sound until the grip judging section 202 detects that the gripping section 102 is being gripped, or may stop the output of the alert sound when gripping is detected. In this way, the user can be prompted to grip the dumbbell 100.

If exercise is not detected by the gyro sensor 114 over a continuous predetermined time interval, the dumbbell 100 may transmit information indicating this fact to at least one of the information terminal 300 and the data server 30. The information terminal 300 and the data server 30 may post a message indicating that the user has not exercised for a while publicly on the Internet 10. Examples of public posting on the Internet 10 include posting on Facebook (Registered Trademark), tweeting on Twitter (Registered Trademark), and the like. In this way, the user can be encouraged to exercise by utilizing the feeling that the user does not want his/her lack of exercise known publicly.

The dumbbell 100 may transmit to the information terminal 300 the number of exercise movements or the like measured by the gyro sensor 114, and the information terminal 300 may use the received information concerning the number of exercise movements in an application. For example, in a character developing game, dating game, or the like, the information terminal 300 perform a process such as progressing more in the game when the received number of exercise movements is higher. In this way, the user can be encouraged to exercise by utilizing the feeling of the user for progressing in the game.

The dumbbell 100 may perform processing in connection with a terminal other than the information terminal 300 and the data server 30. For example, the dumbbell 100 may perform processing in connection with a home appliance. For example, in connection with an air-conditioner, the dumbbell 100 may communicate with the air-conditioner to lower the temperature setting of the air-conditioner when rigorous exercise movement is measured by the gyro sensor 114.

Figure 7:
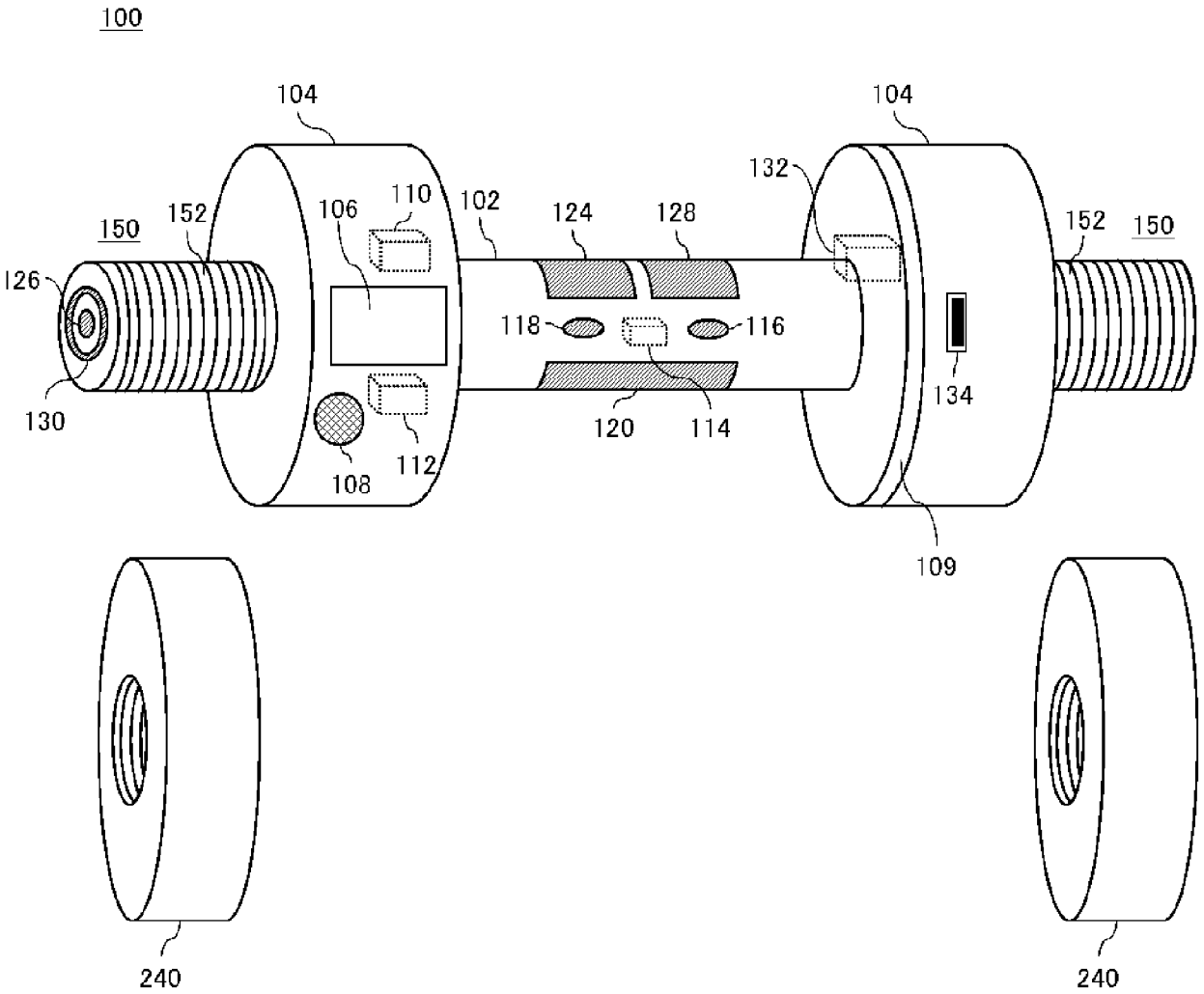
FIG. 7 schematically shows another exemplary function configuration of the dumbbell 100.

FIG. 7 schematically shows another exemplary configuration of a dumbbell 100. Here, the description focuses mainly on the differences relative to the dumbbell 100 of FIG. 2. The dumbbell 100 shown in FIG. 7 includes a weight holding section 150 that holds an externally attached weight 240. The weight holding section 150 has a bolt shape, and the weight 240 has a nut shape. The weight holding section 150 includes a pressure sensor 152 that measures the pressure resulting from the tightening by the but-shaped weight 240.

The processing unit 112 acquires the pressure measured by the pressure sensor 152. The processing unit 112 may judge whether the acquired pressure is less than a predetermined standard. If the acquired pressure is less than the predetermined standard, the output control section 220 may perform a notification process. For example, the output control section 220 cause causes the display 106, the speaker 108, and the light emitting section 109 to output an alert. In this way, the user can be notified that the holding strength by which the weight 240 is held is low.

The processing unit 112 may periodically acquire the pressure from the pressure sensor 152, and judge whether the acquired pressure is less than the predetermined standard. The processing unit 112 may perform the pressure acquisition and the judgment concerning whether the pressure is less than the standard only while the gripping section 102 is judged to be gripped by the grip judging section 202. The processing unit 112 is an example of a holding strength judging section, and the output control section 220 is an example of a notification process performing section.

Figure 8:
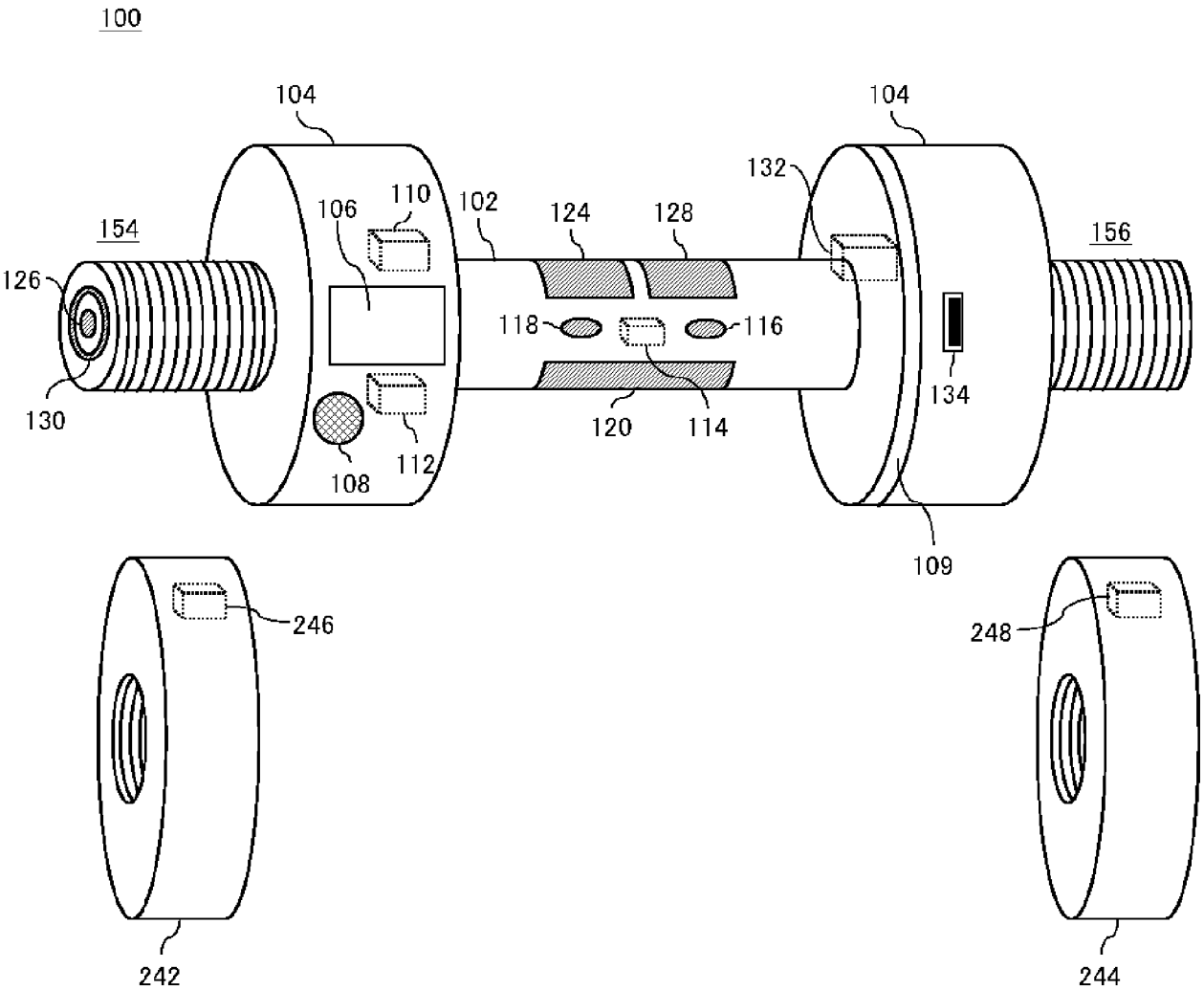
FIG. 8 schematically shows another exemplary function configuration of the dumbbell 100.

FIG. 8 schematically shows another exemplary configuration of a dumbbell 100. Here, the description focuses mainly on the differences relative to the dumbbell 100 of FIG. 2. The dumbbell 100 shown in FIG. 8 includes a first weight holding section 154 that holds an externally attached second weight 242 and a second weight holding section 156 that holds an externally attached second weight 244. The first weight holding section 154 and the second weight holding section 156 are bolt shaped, and the first weight 242 and the second weight 244 are nut shaped.

The first oscillation sensor 246 and the second oscillation sensor 248 each have a wireless communication function, and perform wireless communication with the communication unit 110. The communication unit 110 receives oscillation information indicating the oscillation of the first weight 242 and the second weight 244 measured respectively by the first oscillation sensor 246 and the second oscillation sensor 248. The processing unit 112 acquires the oscillation information from the communication unit 110.

The processing unit 112 judges whether the holding force exerted by the first weight holding section 154 and the second weight holding section 156 is less than a predetermined standard, based on the oscillation information acquired from the first oscillation sensor 246 and the oscillation information acquired from the second oscillation sensor 248. For example, if the difference between the oscillation indicated by the oscillation information acquired from the first oscillation sensor 246 and the oscillation indicated by the oscillation information acquired from the second oscillation sensor 248 is greater than a predetermined threshold value, the processing unit 112 judges that the holding force exerted by the first weight holding section 154 and the second weight holding section 156 is less than the predetermined standard.

If the holding force of the first weight holding section 154 drops, the holding force of the second weight holding section 156 drops, or the holding forces of both the first weight holding section 154 and the second weight holding section 156 drop, the first weight 242 and the second weight 244 oscillate during exercise. For example, if the holding force of one of the first weight holding section 154 and the second weight holding section 156 drops, one of the first weight 242 and the second weight 244 oscillates. Furthermore, if the holding forces of both the first weight holding section 154 and the second weight holding section 156 drop, depending on the difference between the respective drops, the first weight 242 and the second weight 244 exhibit different oscillation.

Accordingly, if the difference between the oscillation indicated by the oscillation information acquired from the first oscillation sensor 246 and the oscillation indicated by the oscillation information acquired from the second oscillation sensor 248 is greater than a predetermined threshold value, it is possible to judge that the holding force for at least one of the first weight 242 and the second weight 244 drops by judging that the holding forces exerted by the first weight holding section 154 and the second weight holding section 156 are less than a predetermined standard.

If the processing unit 112 judges that a holding force is less than a predetermined standard, the output control section 220 performs a notification process. For example, the output control section 220 causes the display 106, the speaker 108, and the light emitting section 109 to output an alert. In this way, the user can be made aware that the holding force for holding a weight 240 is low. There are cases where oscillation is added to the first oscillation sensor 246 and the second oscillation sensor 248 when the user is performing exercise normally, but such cases usually result in substantially the same oscillation being added to the first oscillation sensor 246 and the second oscillation sensor 248. Accordingly, by using the oscillation difference for the comparison, the processing unit 112 can prevent alerts from being output in such cases.

The communication unit 110 is an example of an oscillation measurement result receiving section. The processing unit 112 is an example of a holding force judging section. The output control section 220 is an example of a notification process performing section. The first oscillation sensor 246 is an example of a first oscillation measuring section. The second oscillation sensor 248 is an example of a second oscillation measuring section.

FIG. 8 is used to describe an example in which the first weight holding section 154 and the second weight holding section 156 are bolt shaped and the first weight 242 and the second weight 244 are nut shaped, but the present invention is not limited to this. Instead of realizing holding by using a bolt shape and a nut shape. The first weight holding section 154 and the second weight holding section 156 may be respectively held by the first weight 242 and the second weight 244 using magnetic force. The processing unit 112 may determine whether the holding forces of the first weight holding section 154 and the second weight holding section 156 are less than the predetermined standard based on the oscillation information acquired from the first oscillation sensor 246 and the second oscillation sensor 248.

The first weight 242 and the second weight 244 need not include the first oscillation sensor 246 and the second oscillation sensor 248, and in such a case the processing unit 112 may determine whether the holding forces are less than the predetermined standard based on the strength of the magnetic forces of the first weight holding section 154 and the second weight holding sections 156. For example, the dumbbell 100 includes a first gaussmeter (not shown) that measures the magnetic force of the first weight holding section 154 and a second gaussmeter (not shown) that measures the magnetic force of the second weight holding section 156. If the magnetic forces acquired from the first gaussmeter and the second gaussmeter are less than the predetermined threshold value, the processing unit 112 judges that the holding forces of the first weight holding section 154 and the second weight holding section 156 are less than the predetermined standard.

Figure 9:
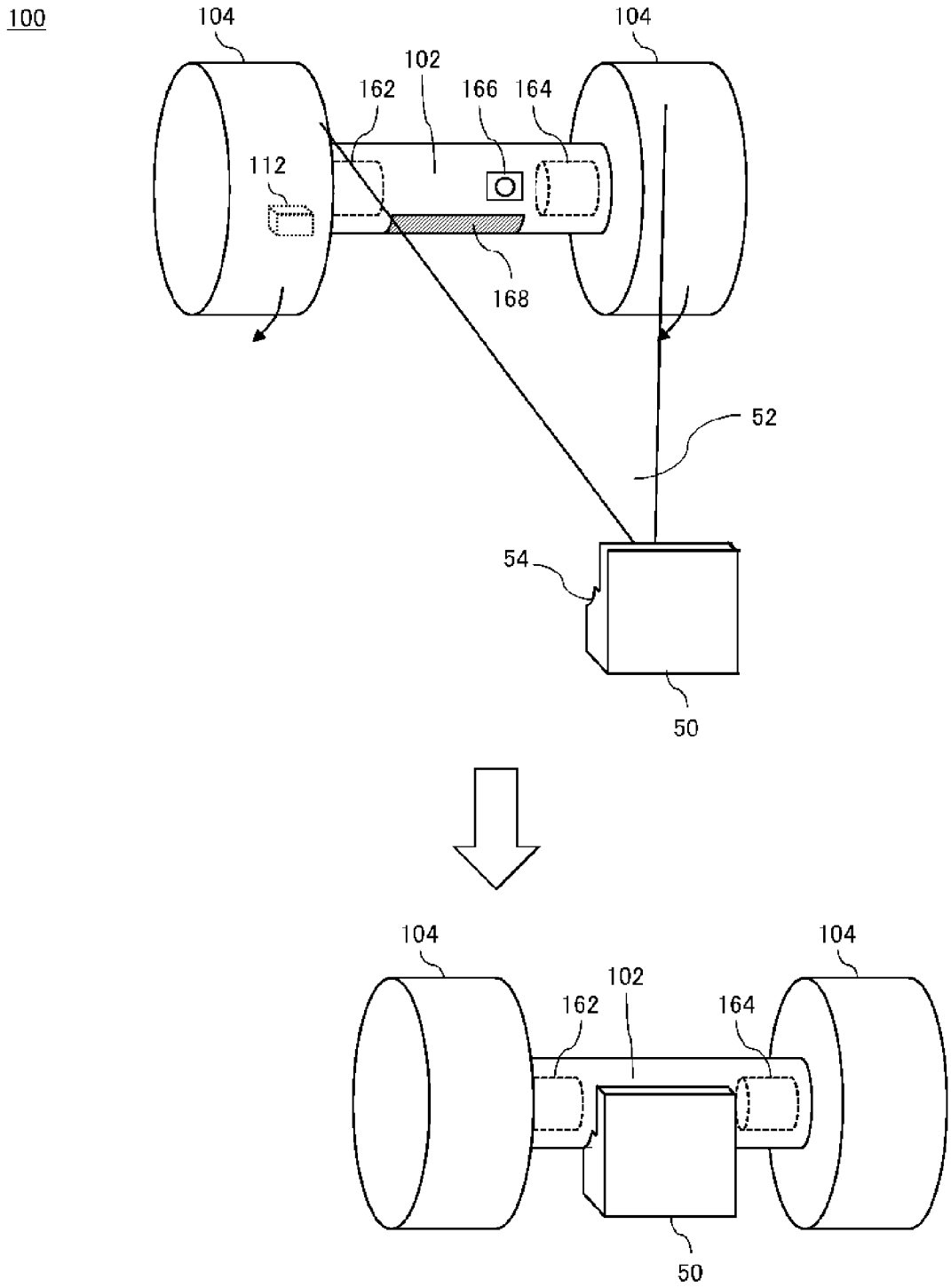
FIG. 9 schematically shows another exemplary function configuration of the dumbbell 100.

FIG. 9 schematically shows another exemplary configuration of a dumbbell 100. Here, the description focuses mainly on the differences relative to the dumbbell 100 of FIG. 2. The dumbbell 100 includes a driving section 162, a driving section 164, an infrared sensor 166, and a charge electrode 168.

The driving section 162 and the driving section 164 are arranged on the gripping section 102. The driving section 162 and the driving section 164 rotationally drive the weight sections 104. By having the driving section 162 and the driving section 164 rotationally drive the weight sections 104 in a state where the dumbbell 100 is placed on the floor, for example, the dumbbell 100 moves. The driving section 162 and the driving section 164 can each independently rotationally drive a weight section 104, and therefore it is possible for the dumbbell 100 to move forward, backward, rotationally, and the like.

The infrared sensor 166 detects the infrared rays 52 output from a station 50. The processing unit 112 can understand the relative position of the station 50 according to the detection result of the infrared rays 52 by the infrared sensor 166. If movement of the dumbbell 100 is not recognized for at least a predetermined time period based on the judgement result of the grip judging section 202, the acquisition result of the temperature acquiring section 204, the acquisition result of the heart rate acquiring section 206, and the like, the processing unit 112 may control the driving section 162, the driving section 164, and the infrared sensor 166 to move to the dumbbell 100 to the station 50. In this way, the dumbbell 100 can be prevented from being left out.

The charge electrode 168 contacts the power supply section 54 of the station 50 when the dumbbell 100 is moved to the station 50. The charge electrode 168 supplies the battery 132 with power received via the power supply section 54. In this way, the battery 132 can be charged.

The processing unit 112 may drive the driving section 162 and the driving section 164 to rotate the weight sections 104 while the user is gripping and exercising with the dumbbell 100. In this way, the user can be provided with a load caused by the rotation, thereby improving the efficiency of the exercise.

The present embodiment described above is an example in which the dumbbell 100 is an example of the exercise equipment, but the present invention is not limited to this. The exercise equipment may be a barbell. The exercise equipment may be an iron dumbbell.

The present embodiment described above is an example in which the gyro sensor 114 is an example of the movement measuring section, but the present invention is not limited to this. The movement measuring section may be an acceleration sensor, or may be both a gyro sensor 114 and an acceleration sensor. If the dumbbell 100 includes the gyro sensor 114 and the acceleration sensor, the burned calorie estimating section 210 may estimate the burned calories from the output values of the gyro sensor 114 and the acceleration sensor and the weight acquired by the weight acquiring section 208.

For example, the burned calorie estimating section 210 detects the movement direction of the dumbbell 100 from the output value of the gyro sensor 114, and calculates the movement distance of the dumbbell 100 by calculating the double integral of the output value of the acceleration sensor. The burned calorie estimating section 210 then calculates the burned calories from the movement distance of the dumbbell 100 and the weight of the dumbbell 100 acquired by the weight acquiring section 208. For example, the burned calorie estimating section 210 calculates the burned calories from the weight and the movement distance by using a conversion table for converting the weight of the dumbbell 100 and the movement distance of the dumbbell 100 into burned calories.

The burned calorie estimating section 210 may estimate the burned calories from only the output value of the gyro sensor 114. For example, the burned calorie estimating section 210 estimates the burned calories using a conversion table for converting the output value of the gyro sensor 114 into burned calories. The burned calorie estimating section 210 may estimate the burned calories from only the output value of the acceleration sensor. For example, the burned calorie estimating section 210 estimates the burned calories using a conversion table for converting the output value of the acceleration sensor into burned calories.

The burned calorie estimating section 210 may estimate the burned calories by calculating the movement energy of the dumbbell 100 from the time during which the dumbbell 100 was used for exercise, the movement distance of the dumbbell 100, and the weight of the dumbbell 100. The burned calorie estimating section 210 may estimate the burned calories by calculating the movement energy from the number of exercise movements of the dumbbell 100 counted based on the output value of the gyro sensor 114 and the weight of the dumbbell 100 acquired by the weight acquiring section 208.

The present embodiment described above is an example in which the communication unit 110 has a wireless communication function, but the present invention is not limited to this. The communication unit 110 may have a wired communication function, or may have both a wireless communication function and a wired communication function. For example, the communication unit 110 may communicate with a terminal connected thereto by a USB cable, via the USB port 134.

While the embodiments of the present invention have been described, the technical scope of the invention is not limited to the above described embodiments. It is apparent to persons skilled in the art that various alterations and improvements can be added to the above-described embodiments. It is also apparent from the scope of the claims that the embodiments added with such alterations or improvements can be included in the technical scope of the invention.

The operations, procedures, steps, and stages of each process performed by an apparatus, system, program, and method shown in the claims, embodiments, or diagrams can be performed in any order as long as the order is not indicated by "prior to," "before," or the like and as long as the output from a previous process is not used in a later process. Even if the process flow is described using phrases such as "first" or "next" in the claims, embodiments, or diagrams, it does not necessarily mean that the process must be performed in this order.

LIST OF REFERENCE NUMERALS

10: Internet, 20: access point, 30: data server, 40: electrical outlet, 42: USB-AC adapter, 50: station, 52: infrared rays, 54: power supply section, 100: dumbbell, 102: gripping section, 104: weight section, 106: display, 108: speaker, 109: light emitting section, 110: communication unit, 112: processing unit, 114: gyro sensor, 116: temperature sensor, 118: heart rate sensor, 120: pressure sensor, 122: pressure sensor, 124: current supply electrode, 126: current supply electrode, 128: voltage detection electrode, 130: voltage detection electrode, 132: battery, 134: USB port, 136: container lid, 138: container section, 140: distance sensor, 142: radiated light, 150: weight holding section, 156: second weight holding section, 162: driving section, 164: driving section, 166: infrared sensor, 168: charge electrode, 180: dumbbell, 202: grip judging section, 204: temperature acquiring section, 206: heart rate acquiring section, 208: weight acquiring section, 210: burned calorie estimating section, 212: personal data storage section, 214: connection detecting section 216: impedance measuring section, 218: body fat percentage calculating section, 220: output control section, 222: sound storage section, 224: current supplying section, 226: voltage detecting section, 240: weight, 242: first weight, 244: second weight, 246: first oscillation sensor, 248: second oscillation sensor, 300: information terminal, 400: mounting platform, 402: mounting section, 404: mounting section, 406: electrical path, 408: electrical path

What is claimed is:

1. Exercise equipment comprising:

a gripping section that is gripped by a user;

a weight section that is connected to the gripping section;

a first electrode that is arranged on the gripping section, the first electrode including a first current supply electrode and a first voltage detection electrode;

a second electrode that is arranged on the weight section, the second electrode including a second current supply electrode and a second voltage detection electrode;

a measuring section that measures at least one of body fat percentage of the user and an electrocardiogram waveform of the user, using the first electrode and the second electrode, the measuring section supplying current to the first current supply electrode and the second current supply electrode, measuring impedance by performing voltage detection on the first voltage detection electrode and the second voltage detection electrode, and calculating the body fat percentage of the user based on the measured impedance and the personal data; and a personal data storage section that stores personal data including height and weight of the user.

2. The exercise equipment according to claim 1, further comprising a body fat percentage output section that outputs the body fat percentage calculated by the measuring section, via at least one of display output and voice output.

3. The exercise equipment set according to claim 1, wherein the exercise equipment is a dumbbell.

4. Exercise equipment comprising:

a gripping section that is gripped by a user;

a weight section that is connected to the gripping section;

a first electrode that is arranged on the gripping section;

a second electrode that is arranged on the weight section, the second electrode being arranged on a surface of the weight section that is opposite a surface connected to the gripping section; and a measuring section that measures at least one of body fat percentage of the user and an electrocardiogram waveform of the user, using the first electrode and the second electrode.

5. The exercise equipment set according to claim 4, wherein the exercise equipment is a dumbbell.

6. Exercise equipment comprising:

a gripping section that is gripped by a user;

a weight section that is connected to the gripping section;

a first electrode that is arranged on the gripping section;

a second electrode that is arranged on the weight section;

a measuring section that measures at least one of body fat percentage of the user and an electrocardiogram waveform of the user, using the first electrode and the second electrode;

a connection detecting section that detects that the first electrode and the second electrode are electrically connected, wherein the measuring section measures at least one of the body fat percentage and the electrocardiogram waveform in response to the detection by the connection detecting section.

7. The exercise equipment set according to claim 6, wherein the exercise equipment is a dumbbell.

8. An exercise equipment set comprising:

first exercise equipment including:

a first gripping section that is gripped by a user;

a first weight that is connected to the first gripping section;

a first electrode that is arranged on the first gripping section;

a second electrode that is arranged on the first weight; and a measuring section that measures body fat percentage of the user or an electrocardiogram waveform of the user; and second exercise equipment including:

a second gripping section that is gripped by the user;

a second weight that is connected to the second gripping section;

a third electrode that is arranged on the second gripping section; and a fourth electrode that is arranged on the second weight, wherein the measuring section measures at least one of the body fat percentage of the user and the electrocardiogram waveform of the user by using the first electrode, the second electrode, the third electrode, and the fourth electrode when the second electrode and the fourth electrode are in contact with each other.

9. The exercise equipment set according to claim 8, wherein the second electrode is arranged on a surface of the first weight that is opposite the surface that is connected to the first gripping section, and the fourth electrode is arranged on a surface of the second weight that is opposite the surface that is connected to the second gripping section.

10. The exercise equipment set according to claim 8, wherein the first electrode includes a first current supply electrode and a first voltage detection electrode, the second electrode includes a second current supply electrode and a second voltage detection electrode, the third electrode includes a third current supply electrode and a third voltage detection electrode, the fourth electrode includes a fourth current supply electrode and a fourth voltage detection electrode, and when the second current supply electrode and the fourth current supply electrode are in contact and the second voltage detection electrode and the fourth voltage detection electrode are in contact, the measuring section supplies current to the first current supply electrode, the second current supply electrode, the third current supply electrode, and the fourth current supply electrode, measures impedance by performing voltage detection on the first voltage detection electrode, the second voltage detection electrode, the third voltage detection electrode, and the fourth voltage detection electrode, and calculates the body fat percentage of the user based on the impedance.

11. The exercise equipment set according to claim 10, wherein one of the second current supply electrode and the second voltage detection electrode is arranged at the center of the first weight, and the other of the second current supply electrode and the second voltage detection electrode has a circular shape that surrounds the one of the second current supply electrode and the second voltage detection electrode arranged at the center of the first weight.

12. The exercise equipment set according to claim 8, further comprising a mounting platform that includes:

a first mounting section on which the first exercise equipment is mounted;

a second mounting section on which the second exercise equipment is mounted; and an electrical path that creates electrical conduction between the second electrode of the first exercise equipment mounted on the first mounting section and the fourth electrode of the second exercise equipment mounted on the second mounting section.

13. The exercise equipment set according to claim 9, wherein the first exercise equipment and the second exercise equipment are a dumbbell.

14. Exercise equipment comprising:

a gripping section that is gripped by a user;

a weight section that is connected to the gripping section;

a temperature measuring section that is arranged on the gripping section or the weight section and measures temperature;

a movement measuring section that measures movement of the exercise equipment; and a burned calorie output section that outputs burned calories of the user estimated based on the movement of the exercise equipment measured by the measuring section and the temperature measured by the temperature measuring section.

15. The exercise equipment according to claim 14, further comprising:

a burned calorie estimating section that estimates the burned calories based on the movement of the exercise equipment measured by the movement measuring section and the temperature measured by the temperature measuring section.

16. The exercise equipment according to claim 14, wherein the burned calorie estimating section estimates the burned calories by adding together an estimated value of burned calories that are burned by exercise using the exercise equipment and an estimated value of calories burned by a basal metabolic rate of the user during a time period of exercise using the exercise equipment, which are calculated while considering body temperature of the user measured by the temperature measuring section.

17. The exercise equipment according to claim 14, further comprising:

a temperature information transmitting section that transmits temperature information indicating the temperature measured by the temperature measuring section to an information terminal;

a movement transmitting section that transmits movement information indicating movement of the exercise equipment measured by the movement measuring section to the information terminal; and a burned calorie receiving section that receives the burned calories estimated based on the temperature information and the movement information, from the information terminal.

18. The exercise equipment according to claim 14, wherein the burned calorie output section outputs the burned calories using at least one of display output, voice output, light output, and transmission output.

19. Exercise equipment comprising:

a gripping section that is gripped by a user;

a weight section that is connected to the gripping section; and a temperature measuring section that is arranged on the gripping section or the weight section and measures temperature, the temperature measuring section being arranged on the gripping section;

a grip judging section that judges whether the user is gripping the gripping section; and a temperature acquiring section that acquires the temperature measured by the temperature measuring section in a state where the user is not gripping the gripping section as the surrounding temperature, and acquires the temperature measured by the temperature measuring section in a state where the user is gripping the gripping section as the body temperature.

20. The exercise equipment according to claim 14, wherein the measuring section measures the surrounding temperature of the exercise equipment and the body temperature of the user gripping the gripping section, and the burned calorie output section outputs the burned calories of the user estimated based on the surrounding temperature and body temperature measured by the temperature measuring section and movement of the exercise equipment measured by the measuring section.

21. The exercise equipment set according to claim 14, further comprises:

a grip judging section that judges whether the user is gripping the gripping section; and a temperature acquiring section that acquires the temperature measured by the temperature measuring section in a state where the user is not gripping the gripping section as the surrounding temperature, and acquires the temperature measured by the temperature measuring section in a state where the user is gripping the gripping section as the body temperature, and wherein the movement measuring section includes at least one of a gyro sensor and an acceleration sensor.

22. The exercise equipment set according to claim 14, wherein the movement measuring section includes at least one of a gyro sensor and an acceleration sensor, and the exercise equipment set further comprising: an output control section which outputs a warning if the movement measuring section detects rolling movement of the exercise equipment.

23. The exercise equipment according to claim 19, wherein the temperature measuring section measures at least one of surrounding temperature of the exercise equipment and body temperature of the user gripping the gripping section.

24. The exercise equipment according to claim 19, wherein the temperature measuring section includes:

a gripping section temperature measuring section that is arranged on the gripping section; and a weight section temperature measuring section that is arranged on the weight section, and the exercise equipment further comprises a temperature acquiring section that acquires the temperature measured by the gripping section temperature measuring section as the body temperature and acquires the temperature measured by the weight section temperature measuring section as the surrounding temperature.

* * * * *